US006332956B1

(12) United States Patent
Lee et al.

(10) Patent No.: US 6,332,956 B1
(45) Date of Patent: Dec. 25, 2001

(54) PULP PRODUCT MANUFACTURING APPARATUS

(75) Inventors: Sang-Han Lee, Seoul; Gu-Ik Cha, Imcheom; Young-Tae Kim, Imcheon, all of (KR)

(73) Assignee: Korea Recystes Co., Ltd., Kimpo (KR)

( * ) Notice: Subject to any disclaimer, the term of this patent is extended or adjusted under 35 U.S.C. 154(b) by 0 days.

(21) Appl. No.: 09/692,473

(22) Filed: Oct. 20, 2000

(30) Foreign Application Priority Data

| | | |
|---|---|---|
| Nov. 30, 1999 | (KR) | 99-26602 |
| Feb. 15, 2000 | (KR) | 00-3970 |
| Apr. 24, 2000 | (KR) | 00-21738 |
| May 8, 2000 | (KR) | 00-24429 |
| Aug. 7, 2000 | (KR) | 00-22471 |

(51) Int. Cl.[7] ..... D21J 3/00

(52) U.S. Cl. ..... 162/378; 162/388; 162/393; 162/394; 162/395; 162/396; 162/411; 162/416; 162/379

(58) Field of Search ..... 162/387, 388, 162/389, 393, 394, 396, 397, 382, 218, 411, 416, 400, 402, 404, 219–230, 407; 425/84, 225; 264/86, 87; 249/113, 114

(56) References Cited

U.S. PATENT DOCUMENTS

| | | | | |
|---|---|---|---|---|
| 3,147,180 | * | 9/1964 | Pellegrino | 162/389 |
| 3,922,191 | * | 11/1975 | Witt et al. | 162/383 |
| 5,399,243 | * | 3/1995 | Miyamoto et al. | 162/274 |
| 6,048,440 | * | 4/2000 | Baker | 162/388 |

FOREIGN PATENT DOCUMENTS

| | | | | |
|---|---|---|---|---|
| 0728868 | * | 8/1996 | (EP) | D21J/7/00 |
| 0745727 | * | 12/1996 | (EP) | D21J/5/00 |
| 0650543 | * | 3/1997 | (EP) | D21J/7/00 |
| 1039028 | * | 9/2000 | (EP) | D21J/7/00 |
| 2500021 | * | 8/1982 | (FR) | D21J/7/00 |
| 10-226999 | * | 8/1998 | (JP) | D21J/3/00 |
| 10-298900 | * | 11/1998 | (JP) | D21J/3/00 |

* cited by examiner

*Primary Examiner*—Peter Chin
*Assistant Examiner*—Carlos Lopez
(74) *Attorney, Agent, or Firm*—Jacobson Holman, PLLC

(57) ABSTRACT

Disclosed is a pulp product manufacturing apparatus. The apparatus comprises a body having a frame and an upper fastening plate, the frame having a pulp fluid bath in which pulp collecting means including a collecting mold part capable of squeezing pulp and discharging water and a raising and lowering part is disposed; first through third upper squeezing means having upper molds and heating parts which are repeatedly raised and lowered by first through third cylinders mounted to the upper fastening plate so as to dry pulp using heat; a plurality of guide columns having upper and lower ends which are respectively fastened to a lower surface of the upper fastening plate and an upper surface of the frame; lower squeezing means including a movable member and first and second lower molds which are repeatedly moved forward and rearward by a forward and rearward moving part which is mounted between both side walls of the frame; washing means arranged at a front portion of the frame and repeatedly moved above the pulp fluid bath for washing the collecting mold part after pulp is removed from the collecting mold part; and pulp sucking means mounted, in forward and rearward directions, to the frame, for sucking and collecting dispersed pulp material.

13 Claims, 16 Drawing Sheets

PULP PRODUCT MANUFACTURING APPARATUS

BACKGROUND OF THE INVENTION

1. Field of the Invention

The present invention relates to a mold washing device of a pulp product manufacturing apparatus, and more particularly, the present invention relates to a pulp product manufacturing apparatus which automatically washes a pulp collecting mold and prevents dispersed pulp material from remaining on a frame and in which guide columns are mounted between the frame and an upper fastening plate so as to serve as posts and to guide raising and lowering movement of upper squeezing means thereby to secure stability upon raising and lowering of the upper squeezing means.

2. Description of the Related Art

Conventionally, a pulp container is used for surrounding an outer contour of an electric home appliance or serves as a packaging receptacle for a precooked food. The pulp container provides advantages in that it can be quickly corroded upon being filled into land and can prevent a noxious component from being mixed with a food. Hereinafter, a construction of a conventional pulp product manufacturing apparatus will be described.

FIG. 10 is a schematic perspective view illustrating a conventional pulp product manufacturing apparatus. The apparatus includes a frame 100. A forming tank 110 is mounted to a front portion of the frame 100, and pulp material which is prepared by decomposing waste paper, is supplied into the forming tank 110. A first lower mold LM1 is actuated up and down through a first cylinder S1 in the forming tank 110 and forces the pulp material to be sucked against a metal mesh M having a predetermined contour. A first upper mold HM1 is actuated through a second cylinder S2. The first upper mold HM1 heats and compresses the pulp material which is sucked against the first lower mold LM1, and then, sucks and moves the resultantly formed pulp material onto a second lower mold LM2. A movable member 120 is repeatedly moved above the forming tank 110 through a horizontal hydraulic cylinder S5, and second and third lower molds LM2 and LM3 are mounted to the movable member 120. Second and third upper molds HM2 and HM3 are respectively actuated by third and fourth cylinders S3 and S4. The second and third upper molds HM2 and HM3 repeatedly heat and compress the resultantly formed pulp material which is sequentially placed on the second and third lower molds LM2 and LM3, and then, discharge a finally manufactured pulp product out of the apparatus.

Therefore, after the pulp material is sucked against the metal mesh M through raising and lowering movement of the first lower mold LM1, the resultantly formed pulp material is heated and compressed through raising and lowering movement of the first through third upper molds HM1, HM2 and HM3 and through forward and rearward movement of the second and third lower molds LM2 and LM3, while being fed in a stepwise manner, thereby to finally manufacture the pulp product.

However, the conventional pulp product manufacturing apparatus constructed as mentioned above suffers from defects in that, since the apparatus serves as basic means for simply manufacturing the pulp product, a surface of the pulp product is roughed. Also, because a washing operation of the first lower mold is manually conducted, productivity is deteriorated. Further, due to the fact that unnecessary structures such as columns are mounted to the apparatus, a cost of the entire manufacturing apparatus is raised.

In other words, since the metal mesh of the first lower mold is manually washed, the pulp material is not completely removed from the metal mesh, and instead, remains on the metal mesh, whereby a defective proportion of end products is increased.

Moreover, while the manufacturing apparatus constructed as mentioned above can manufacture a packing case having a predetermined configuration, a food container or the like, it cannot manufacture a thick pulp plate.

Further, while guide shafts which are raised and lowered through an upper fastening plate, are disposed on a single upper plate which constitutes the upper molds, to guide raising and lowering movement of the upper molds, since the guide shafts are raised and lowered along with the upper molds, the manufacturing apparatus weighs too much, whereby a great deal of power is consumed by the cylinders. Furthermore, because the guide shafts extend only through the upper fastening plate, the upper molds are seriously fluctuated while being raised and lowered, whereby a defective proportion of end products can be further increased.

SUMMARY OF THE INVENTION

Accordingly, the present invention has been made in an effort to solve the problems occurring in the related art, and an object of the present invention is to provide a pulp product manufacturing apparatus which automatically washes a pulp collecting mold and prevents dispersed pulp material from remaining on a frame and in which guide columns are mounted between the frame and an upper fastening plate in such a way as to serve as posts and guide raising and lowering movement of upper squeezing means, whereby quality of pulp products and productivity of the manufacturing apparatus are improved, an expense required for disposing separate columns can be saved, and it is possible to secure stability upon raising and lowering of the upper squeezing means.

Another object of the present invention is to provide a pulp product manufacturing apparatus in which a raising and lowering part constituting pulp collecting means is arranged outside a pulp fluid bath, whereby a volume of the pulp fluid bath is minimized, it is possible to prevent the raising and lowering part from being corroded due to pulp fluid or the pulp fluid from being solidified on the raising and lowering part, and a repairing operation for the raising and lowering part can be implemented in an easy manner.

Another object of the present invention is to provide a pulp product manufacturing apparatus in which a forward and rearward moving part constituting lower squeezing means is disposed below a movable member, whereby it is possible to prevent foreign substances such as pulp material from flowing into a cylinder constituting the forward and rearward moving part.

Another object of the present invention is to provide a pulp product manufacturing apparatus in which an angle of each of a plurality of nozzles mounted to a lower surface of a washing body can be adjusted depending upon a configuration of a collecting mold part, whereby a removing effect for the pulp material remaining on a metal mesh of the collecting mold part can be elevated.

Another object of the present invention is to provide a pulp product manufacturing apparatus which can manufacture a thick pulp plate having a proper thickness.

Still another object of the present invention is to provide a pulp product manufacturing apparatus in which hot wires are arranged in a horizontal direction in a hot plate constituting a heating part of the upper squeezing means, whereby a hot wire changing operation can be implemented without disassembling the raising and lowering part from the apparatus, and thereby, it is possible to quickly repair the hot wires as occasion arises.

Yet still another object of the present invention is to provide a pulp product manufacturing apparatus in which only upper molds constituting the upper squeezing means are heated, whereby heat loss is minimized and a preheating time is shortened when arranging the manufacturing apparatus for a manufacturing procedure.

In order to achieve the above object, according to one aspect of the present invention, there is provided a pulp product manufacturing apparatus comprising: a body having a frame and an upper fastening plate, the frame having a pulp fluid bath in which pulp collecting means including a collecting mold part capable of squeezing pulp and discharging water and a raising and lowering part is disposed, the upper fastening plate being disposed at a predetermined separation from an upper end of the frame; first through third upper squeezing means respectively having upper molds and heating parts which are repeatedly raised and lowered by first through third cylinders mounted to the upper fastening plate so as to dry pulp using heat; a plurality of guide columns extending through corner portions of the first through third upper squeezing means and having upper and lower ends which are respectively fastened to a lower surface of the upper fastening plate and an upper surface of the frame; lower squeezing means including a movable member and first and second lower molds which are repeatedly moved forward and rearward by a forward and rearward moving part which is mounted between both side walls of the frame; washing means arranged at a front portion of the frame and repeatedly moved above the pulp fluid bath for washing the collecting mold part after pulp is removed from the collecting mold part; and pulp sucking means mounted, in forward and rearward directions, to the frame adjacent to the upper end of the frame, for sucking and collecting dispersed pulp material.

BRIEF DESCRIPTION OF THE DRAWINGS

The above objects, and other features and advantages of the present invention will become more apparent after a reading of the following detailed description when taken in conjunction with the drawings, in which:

FIGS. 6*a* through 6*e* illustrate a mounted state of washing means according to the present invention, wherein FIG. 6*a* is a perspective view showing the mounted state of the washing means, FIG. 6*b* is a schematic side view showing a state before the washing means is actuated, FIG. 6*c* is a schematic side view showing an actuating state of the washing means, FIG. 6*d* is a cross-sectional view taken along the line C—C of FIG. 6*c*, and FIG. 6*e* is a cross-sectional view taken along the line D—D of FIG. 6*d;*

FIGS. 9*a* through 9*c* illustrate upper squeezing means in accordance with still another embodiment of the present invention, wherein FIG. 9*a* is a side view showing an entire structure of the upper squeezing means, FIG. 9*b* is a cross-sectional view showing a heater box, and FIG. 9*c* is a cross-sectional view taken along the line E—E of FIG. 9*b*.

DETAILED DESCRIPTION OF PREFERRED EMBODIMENTS

Figure 1:
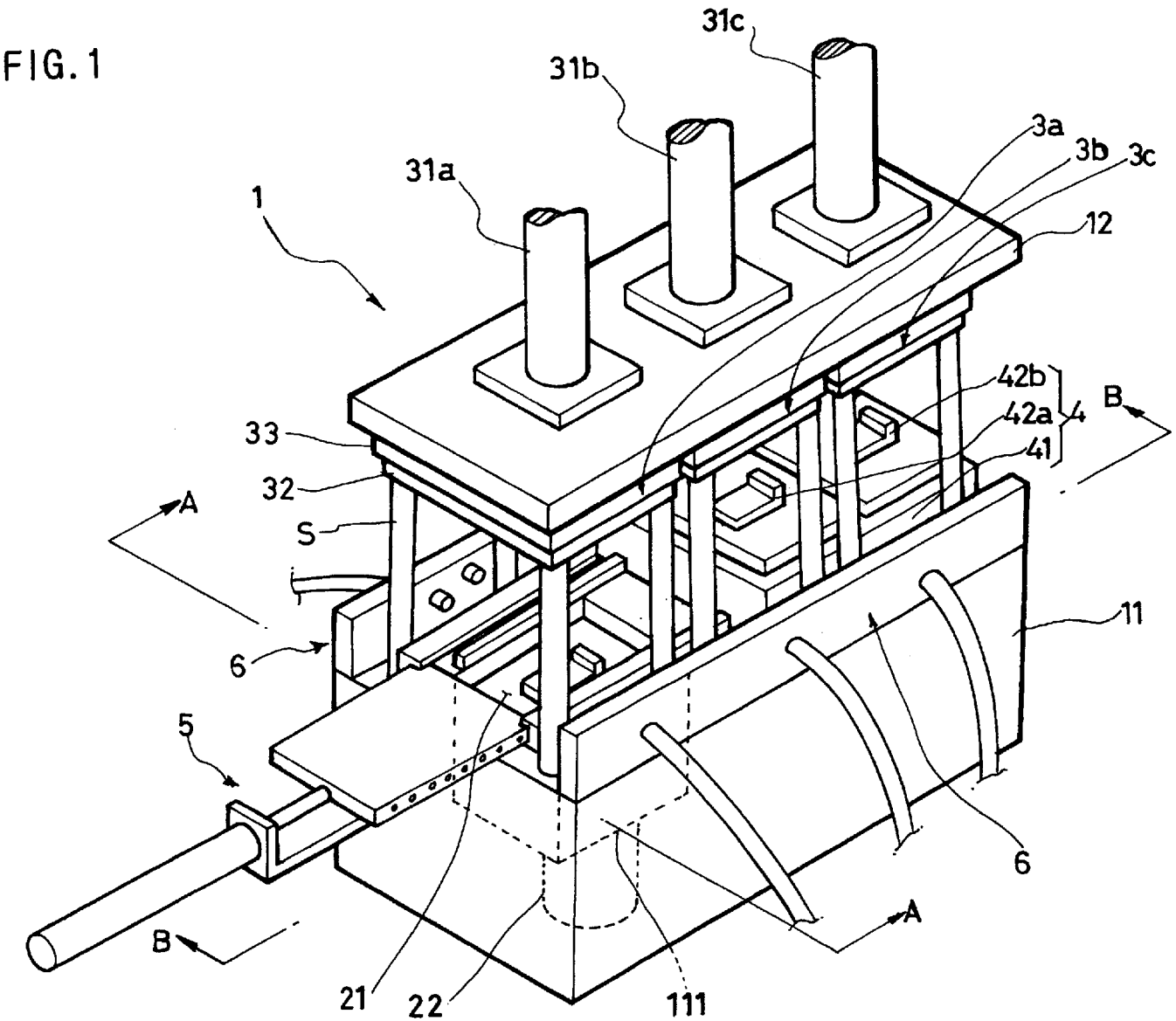
FIG. 1 is a perspective view illustrating a pulp product manufacturing apparatus in accordance with an embodiment of the present invention.

Reference will now be made in greater detail to a preferred embodiment of the invention, an example of which is illustrated in the accompanying drawings. Wherever possible, the same reference numerals will be used throughout the drawings and the description to refer to the same or like parts.

Figure 2:
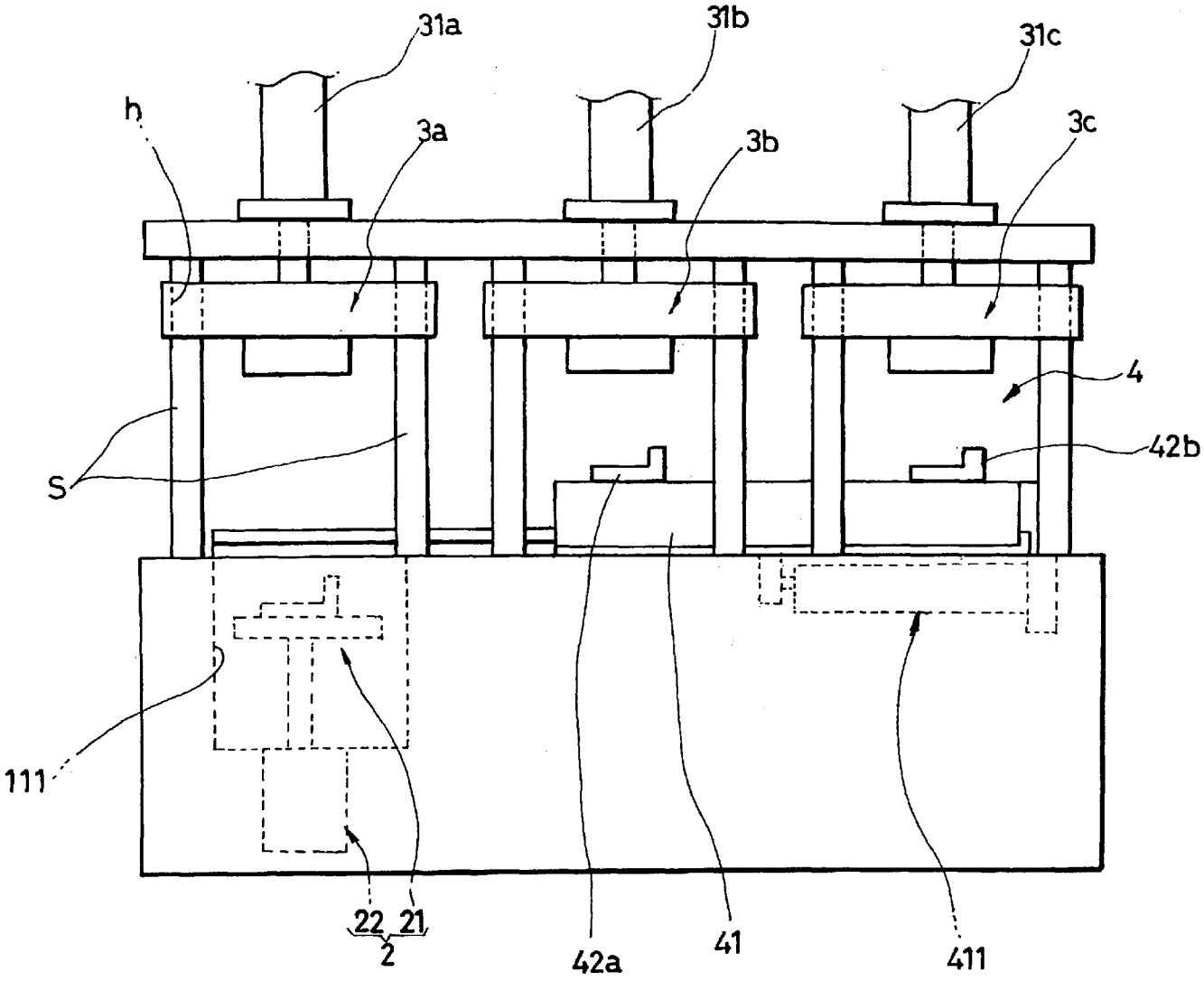
FIG. 2 is a side view illustrating the pulp product manufacturing apparatus according to the present invention, with a front part omitted.

FIG. 1 is a perspective view illustrating a pulp product manufacturing apparatus in accordance with an embodiment of the present invention; and FIG. 2 is a side view illustrating the pulp product manufacturing apparatus according to the present invention, with a front part omitted. Hereinafter, a construction of the pulp product manufacturing apparatus according to the present invention will be first described.

The apparatus includes a body 1, first through third upper squeezing means 3*a*, 3*b* and 3*c*, a plurality of guide columns S, lower squeezing means 4, washing means 5, and pulp sucking means 6. The body 1 has a frame 11 and an upper fastening plate 12. The frame 11 has a pulp fluid bath 111 in which pulp collecting means 2 is disposed. The upper fastening plate 12 is disposed at a predetermined separation from an upper end of the frame 11. The first through third upper squeezing means 3*a*, 3*b* and 3*c* have upper molds 32 which are repeatedly raised and lowered by first through third cylinders 31*a*, 31*b* and 31*c* mounted to the upper fastening plate 12 and are maintained at a predetermined temperature. The plurality of guide columns S extend through corner portions of the first through third upper squeezing means 3*a*, 3*b* and 3*c* and have upper and lower ends which are respectively fastened to a lower surface of the upper fastening plate 12 and an upper surface of the frame 11. The plurality of guide columns S function to keep a distance between the frame 11 and the upper fastening plate 12 constant. The lower squeezing means 4 is mounted between both side walls of the frame 11 and is repeatedly moved forward and rearward. The lower squeezing means 4 includes lower molds. The washing means 5 is arranged at a front portion of the frame 11 and is repeatedly moved above the pulp fluid bath 111 for washing a collecting mold part 21 of the pulp collecting means 2 after a pulp forming is removed from the collecting mold part 21. The pulp sucking means 6 is mounted, in forward and rearward directions, to the frame 11 adjacent to the upper end of the frame 11, for sucking and thereby collecting dispersed pulp material.

In particular, the pulp collecting means 2 includes the collecting mold part 21 against which pulp residing in the pulp fluid bath 111 is squeezed and a raising and lowering part 22 which raises and lowers the collecting mold part 21.

The first through third upper squeezing means 3*a*, 3*b* and 3*c* include upper molds 32 which repeatedly press the collecting mold part 21 against first and second lower molds 42*a* and 42*b* and heating parts 33 which keep temperatures of the upper molds 32 constant.

The corner portions of the first through third upper squeezing means 3*a*, 3*b* and 3*c* are defined with a plurality of guide holes h through which the plurality of guide columns S respectively extend.

The lower squeezing means 4 is repeatedly moved forward and rearward by a forward and rearward moving part 411 which is mounted between the both side walls of the frame 11. The lower squeezing means 4 includes a movable member 41 which is connected with the forward and rearward moving part 411 and the first and second lower molds 42*a* and 42*b* which are mounted to an upper surface of the movable member 41.

Hence, in the case that the pulp product manufacturing apparatus constructed as mentioned above is operated, after pulp is squeezed against the collecting mold part 21 through raising and lowering movement of the pulp collecting means 2, the resultant pulp forming is sequentially moved through raising and lowering movement of the first through third upper squeezing means 3*a*, 3*b* and 3*c* and forward and rearward movement of the lower squeezing means 4 to which the first and second lower molds 42*a* and 42*b* are mounted, and then, is heated and compressed to complete a pulp product.

More concretely speaking the above operations, the collecting mold part 21 of the pulp collecting means 2 is first lowered to be immersed in the pulp fluid bath 111, and pulp material is squeezed against a surface of the collecting mold part 21. Then, the collecting mold part 21 is raised, and, by lowering and raising the first upper squeezing means 3*a*, the pulp forming which is squeezed against the surface of the collecting mold part 21, is picked out. Thereafter, the pulp collecting means 2 is lowered again, the movable member 41 is moved forward, the first upper squeezing means 3*a* is lowered to place the pulp forming on a surface of the first lower mold 42*a*, and the movable member 41 is returned to its original position. Next, by lowering and raising the second upper squeezing means 3*b*, the pulp forming placed on the surface of the first lower mold 42*a*, is picked out, and then, the movable member 41 is moved forward again thereby to position the second lower mold 42*b* below the second upper squeezing means 3*b*. Thereupon, by lowering again the second upper squeezing means 3*b*, the pulp forming is placed on a surface of the second lower mold 42*b*, and then, the movable member 41 is returned to its original position. After that, by lowering and raising the third upper squeezing means 3*c*, the pulp forming placed on the surface of the second lower mold 42*b*, is picked out to be discharged out of the apparatus, whereby manufacturing of the pulp product is completed.

After the pulp collecting means 2 is raised and the pulp forming is picked out by the first upper squeezing means 3*a*, the washing means 5 which is arranged at the front portion of the frame 11, is moved above the pulp fluid bath 111 and washes the collecting mold part 21 of the pulp collecting means 2.

In the above-described operation, pulp material, water and the like which are dispersed over the upper surface of the frame 11, are sucked by the pulp sucking means 6, whereby it is possible to prevent pulp material from being solidified on the upper surface of the frame 11.

Hereinbelow, the pulp product manufacturing apparatus according to the present invention will be described in further detail.

Figure 3:
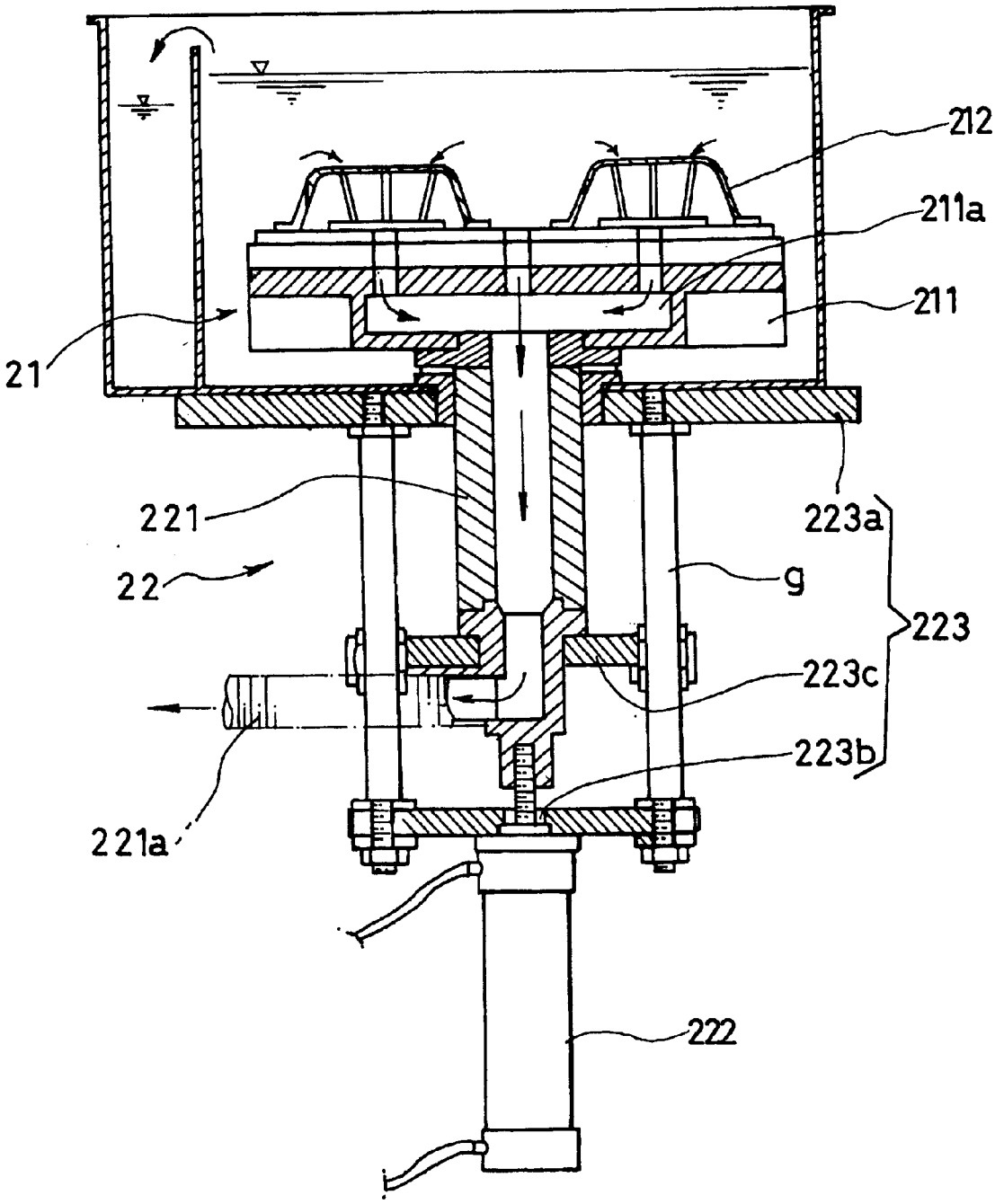
FIG. 3 is a cross-sectional view taken along the line A—A of FIG. 1.

FIG. 3 is a cross-sectional view taken along the line A—A of FIG. 1. As described above, the pulp collecting means 2 includes the collecting mold part 21 against which pulp residing in the pulp fluid bath 111 is squeezed and the raising and lowering part 22 which raises and lowers the collecting mold part 21.

The collecting mold part 21 of the pulp collecting means 2 includes a raising and lowering body 211 in which a water discharging space 211a is defined, and at least one mesh mold 212 which is mounted onto the raising and lowering body 211 and has a configuration of a desired pulp product. The raising and lowering part 22 of the pulp collecting means 2 includes a water discharging pipe 221, a cylinder 222 and a guide portion 223. The water discharging pipe 221 is mounted to a lower end of the raising and lowering body 211 in such a way as to be communicated with the water discharging space 211*a* and extends through a bottom of the pulp fluid bath 111. A flexible tube 221*a* is connected to the water discharging pipe 221. The cylinder 222 is vertically mounted to a lower end of the water discharging pipe 221. The guide portion 223 functions to guide movement of the water discharging pipe 221 upon raising and lowering of a rod of the cylinder 222.

The guide portion 223 comprises an upper body 223*a*, a lower body 223*b* and a moving bracket 223*c*. The upper body 223*a* is mounted to a lower surface of the pulp fluid bath 111. Upper ends of a plurality of guide shafts g are fastened to the upper body 223*a*. The lower body 223*b* is mounted to an upper end surface of the cylinder 222. The rod of the cylinder 222 passes through the lower body 223*b*, and lower ends of the plurality of guide shafts g are fastened to the lower body 223*b*. The moving bracket 223*c* is arranged adjacent to the lower end of the water discharging pipe 221 and is repeatedly raised and lowered along the plurality of guide shafts g when the cylinder 222 is actuated.

Therefore, in the case that the pulp collecting means 2 is operated, by actuating the cylinder 222 which is connected with the water discharging pipe 221 mounted to the lower end of the raising and lowering body 211, the collecting mold part 21 can be raised and lowered. Further, by the fact that the water discharging pipe 221 is moved along the plurality of guide shafts g of the guide portion 223 constituting the raising and lowering part 22, stroke effecting force can be obtained in an adequate manner.

As a consequence, due to the fact that the raising and lowering part 22 is disposed outside the pulp fluid bath 111, an unnecessary bulk of the pulp fluid bath 111 is removed, the raising and lowering part 22 is prevented from being corroded due to pulp fluid or the pulp fluid is prevented from being solidified on the raising and lowering part 22, and a repairing operation for the raising and lowering part can be implemented in an easy manner.

Figure 4:
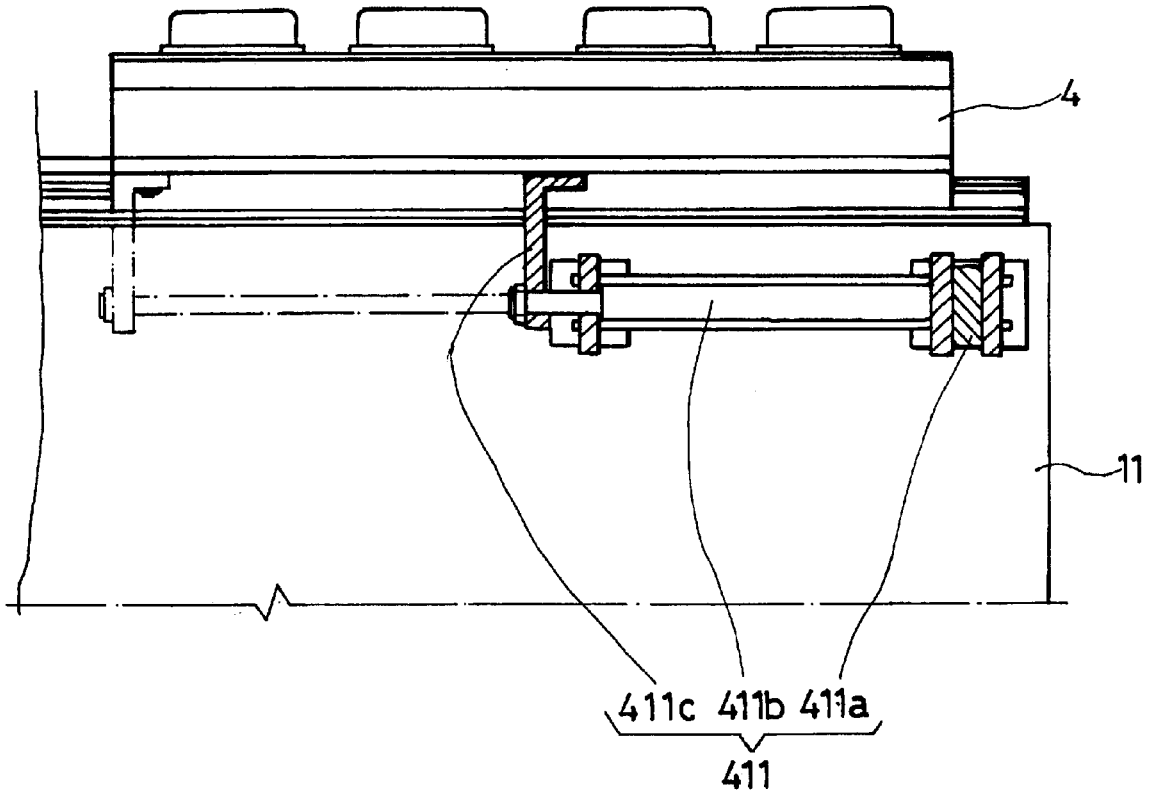
FIG. 4 is a schematic cross-sectional view taken along the line B—B of FIG. 1.

FIG. 4 is a schematic cross-sectional view taken along the line B—B of FIG. 1. The forward and rearward moving part 411 which constitutes the lower squeezing means 4, includes a cylinder bracket 411*a*, at least one cylinder 411*b* and at least one supporting plate 411*c*. The cylinder bracket 411*a* connects rear ends of the both side walls of the frame 11 with each other. The cylinder 411*b* is mounted to a center portion of the cylinder bracket 411*a* in a manner such that a rod of the cylinder 411*b* can be freely moved in the forward and rearward directions. The supporting plate 411*c* connects the rod of the cylinder 411*b* and the movable member 41 with each other.

Accordingly, by the fact that the forward and rearward moving part 411 of the lower squeezing means 4 is disposed below the movable member 41, it is possible to prevent foreign substances such as pulp material from flowing into the cylinder 411*b* which constitutes the forward and rearward moving part 411, whereby the manufacturing apparatus is kept from being broken down.

Figure 5:
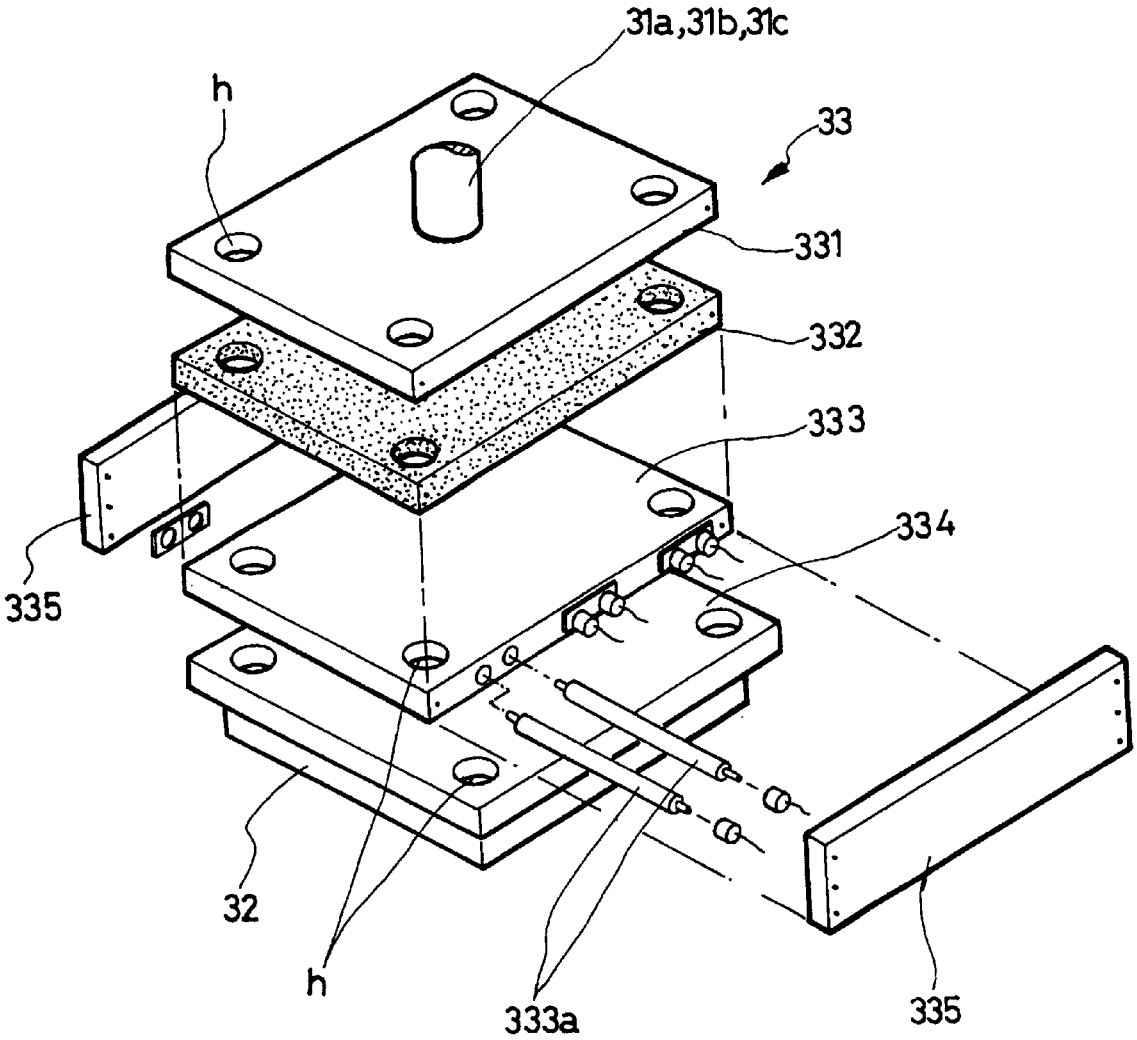
FIG. 5 is an exploded perspective view illustrating upper squeezing means according to the present invention.

FIG. 5 is an exploded perspective view illustrating the upper squeezing means according to the present invention. Each of the heating parts 33 which constitute the first through third upper squeezing means 3*a*, 3*b* and 3*c*, includes a single upper plate 331, a heat insulating element 332, a hot plate 333, a mold base 334 and a pair of covers 335. The single upper plate 331 is fastened to a rod of each cylinder 31*a*, 31*b* or 31*c*. The heat insulating element 32 is attached to a lower surface of the single upper plate 331. The hot plate 333 is attached to a lower surface of the heat insulating element 332, and a plurality of hot wires 333*a* are arranged in the hot plate 333 along a horizontal direction. The mold base 334 is attached to a lower surface of the hot plate 333, and each of the upper molds 32 is mounted to the mold base 334. The pair of covers 335 are disposed at both sides of the single upper plate 331, hot plate 333 and mold base 334 in such a way as to enable the hot wires 333*a* to be changed with new ones by removing them.

Consequently, by arranging the plurality of hot wires 333*a* in the hot plate 333 along the horizontal direction and disposing, sideward of the hot wires 333*a*, the pair of covers 335 which enable the hot wires 333*a* to be easily changed with new ones, a hot wire changing operation can be conveniently implemented without disassembling the upper squeezing means from the manufacturing apparatus, whereby it is possible to quickly repair the hot wires 333*a* as occasion arises.

Figure 6A:
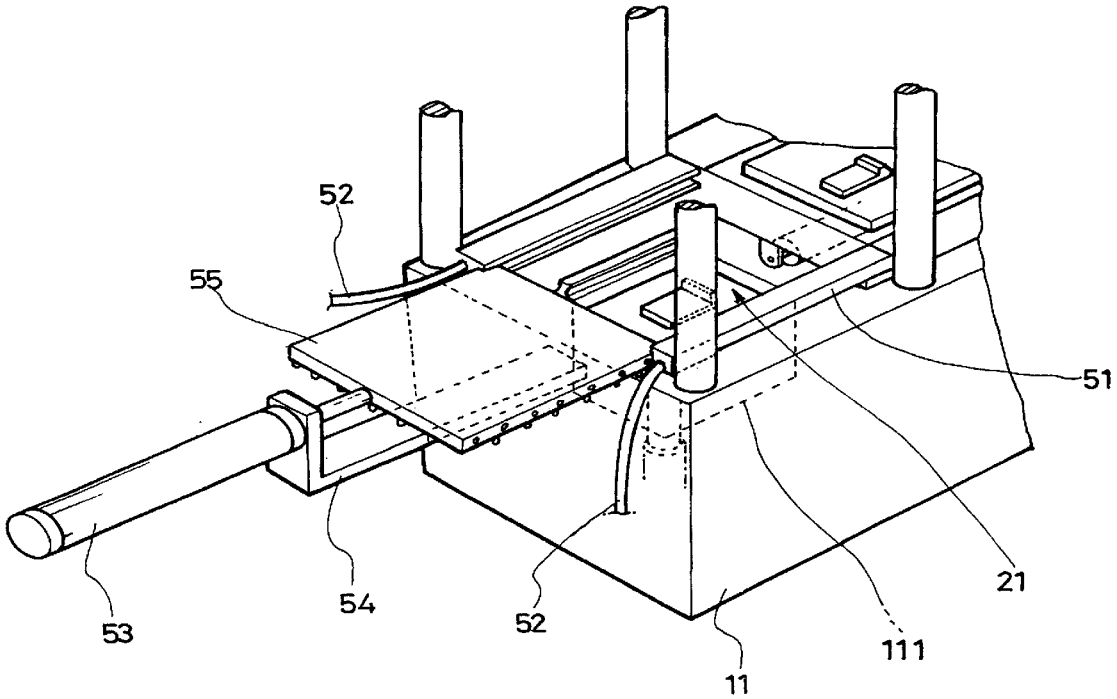
Figure 6B:
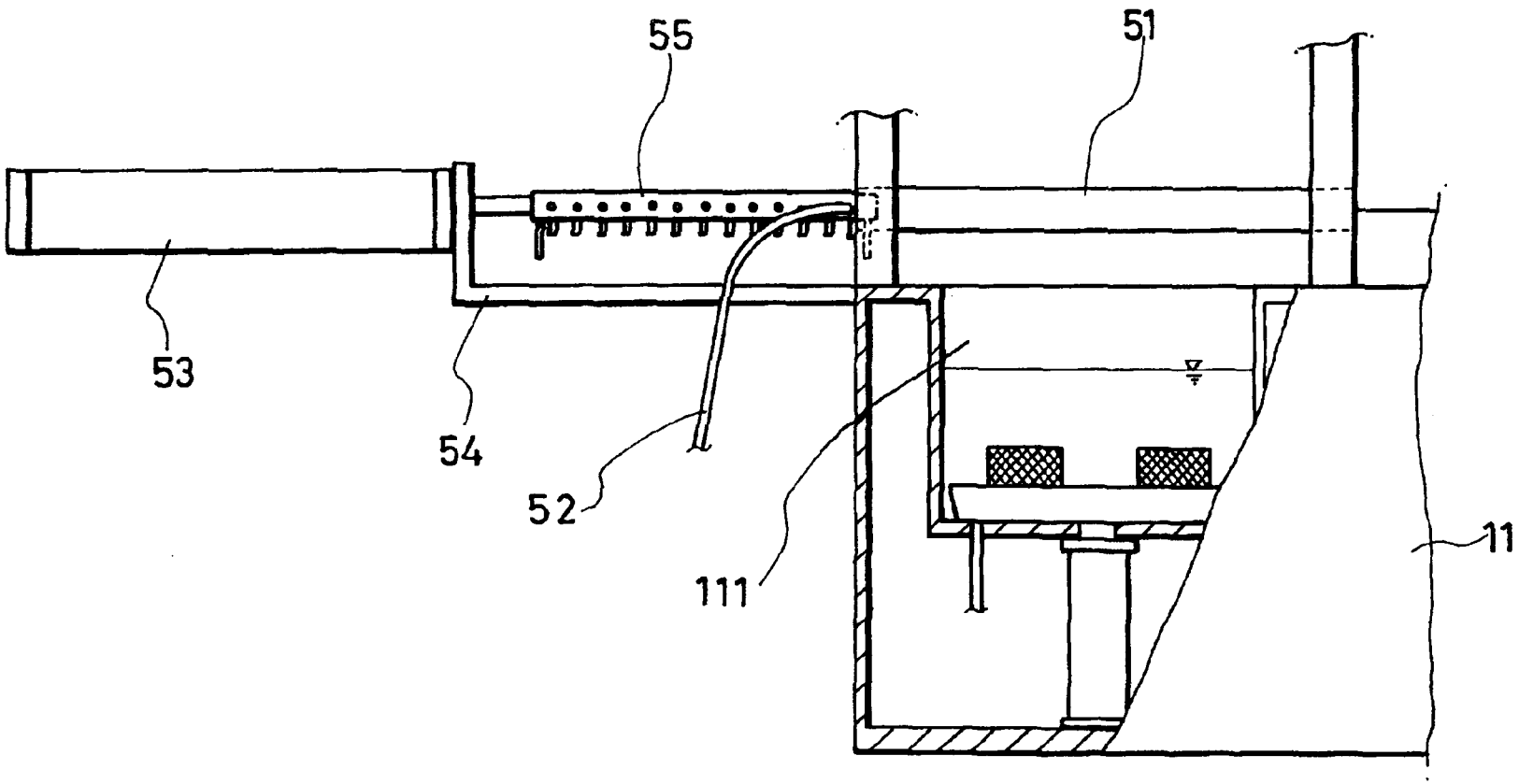
Figure 6C:
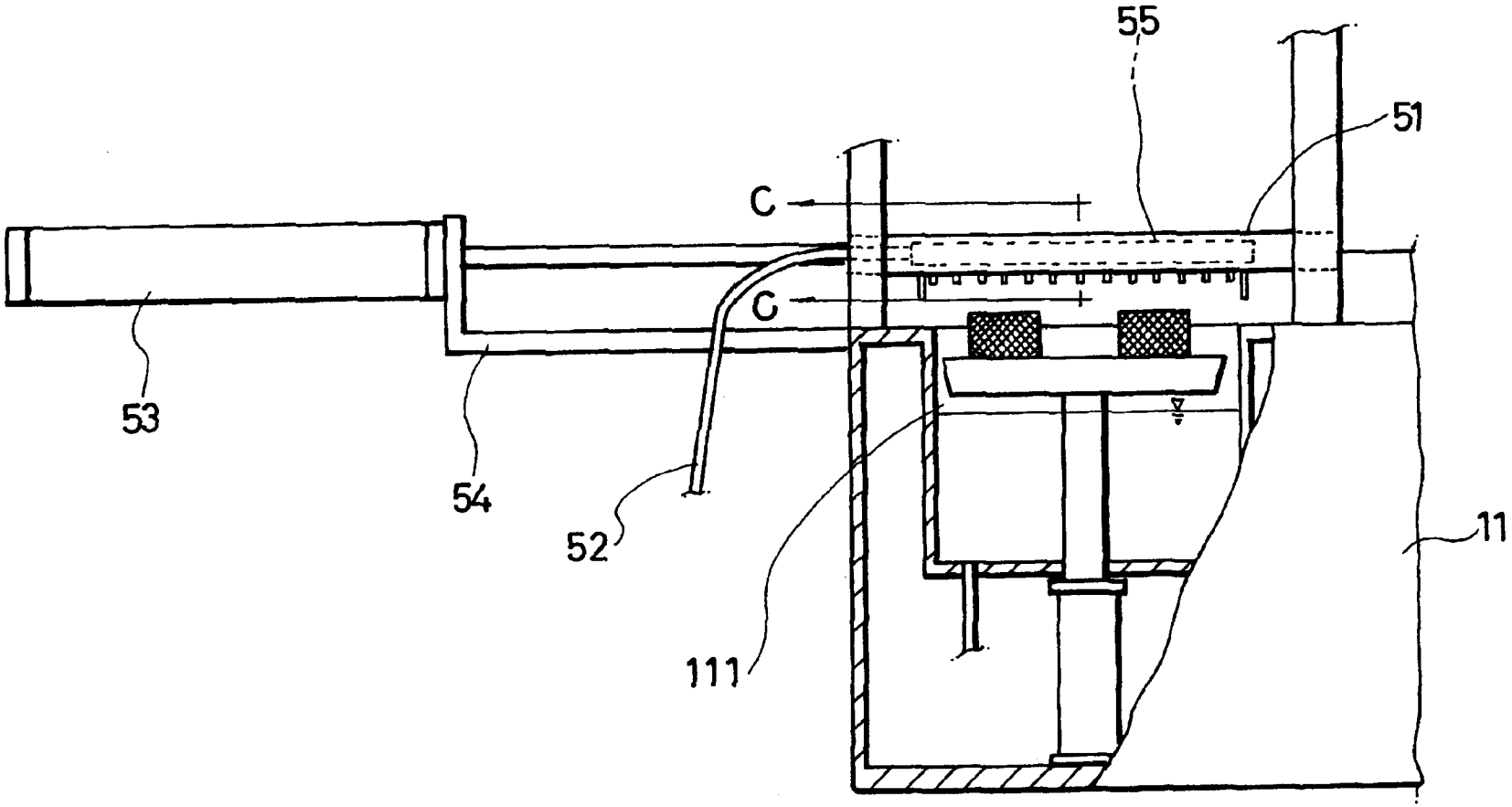

FIGS. 6*a* through 6*e* illustrate a mounted state of the washing means according to the present invention. As shown in FIGS. 6*a*, 6*b*, and 6*c*, the washing means 5 includes a pair of horizontal guides 51, a bracket 54 and a washing body 55. The pair of horizontal guides 51 are respectively mounted to both sides of the frame 11, and a pair of water supplying hoses 52 are respectively connected to the pair of horizontal guides 51. The bracket 54 is fastened to a front end of the frame 11, and a horizontal cylinder 53 is mounted to the bracket 54. The washing body 55 is fastened to a free end of a rod of the horizontal cylinder 53 and is slidably fitted between the pair of horizontal guides 51. A plurality of nozzles 551, each capable of being adjusted in its angle, are mounted to a lower surface of the washing body 55.

Figure 6D:
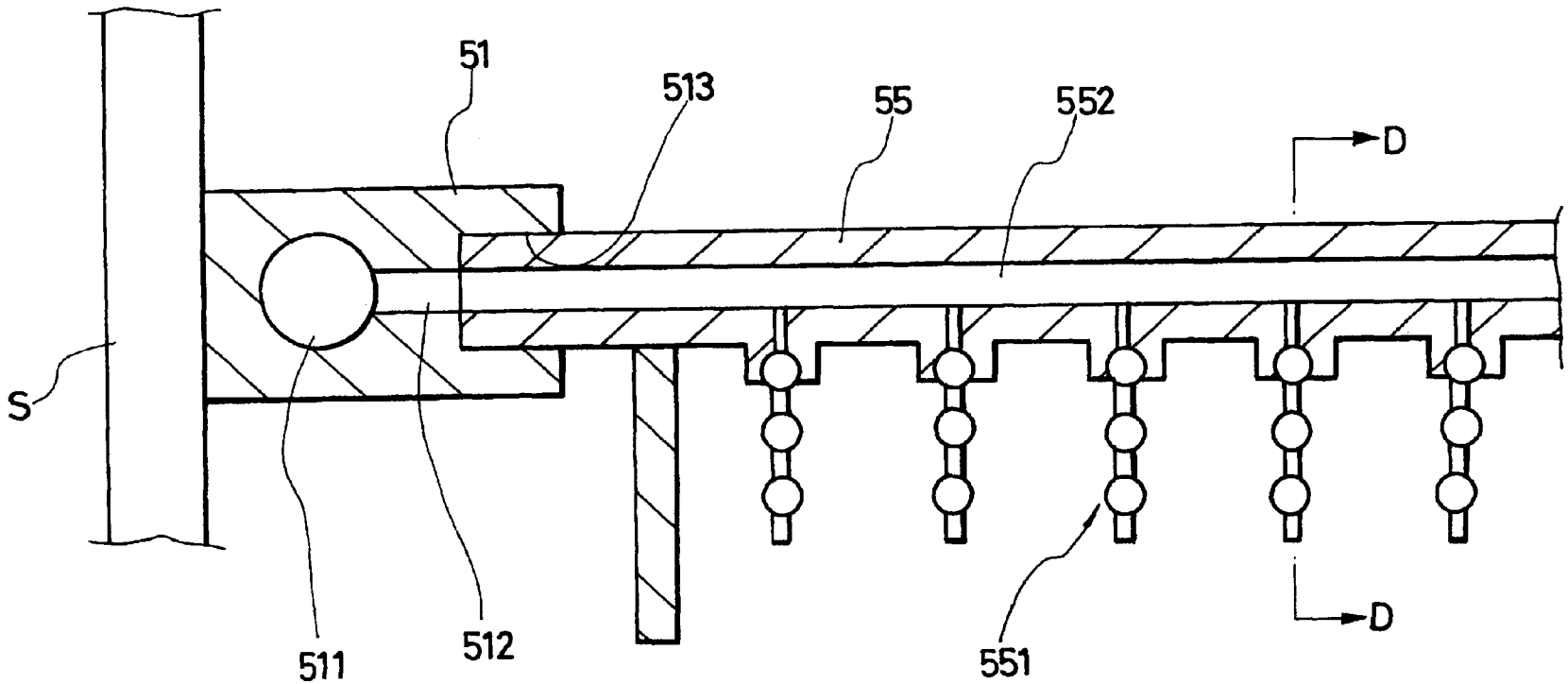

Further, as shown in FIG. 6*d*, a main passage 511 to which water is supplied, is defined in a middle portion of each horizontal guide 51. A plurality of branched passages 512 which extend in a direction orthogonal to the main passage 511, are defined in the horizontal guide 51 in such a way as to be communicated at one ends thereof with the main passage 511. The plurality of branched passages 512 are spaced apart one from another by a predetermined distance. An elongate groove 513 into which one side end of the washing body 55 is slidably fitted, is defined on an inner wall surface of the horizontal guide 51 in such a way as to be communicated with the other ends of the plurality of branched passages 512. A plurality of water passing holes 552 are defined through the washing body 55 in such a way as to be communicated with the plurality of branched passages 512 for receiving water. The plurality of water passing holes 552 are spaced apart one from another by the predetermined distance by which the plurality of branched passages 512 are spaced apart one from another. The plurality of nozzles 551 are mounted to the lower surface of the washing body 55 in such a way as to be vertically communicated with the plurality of water passing holes 552.

Figure 6E:
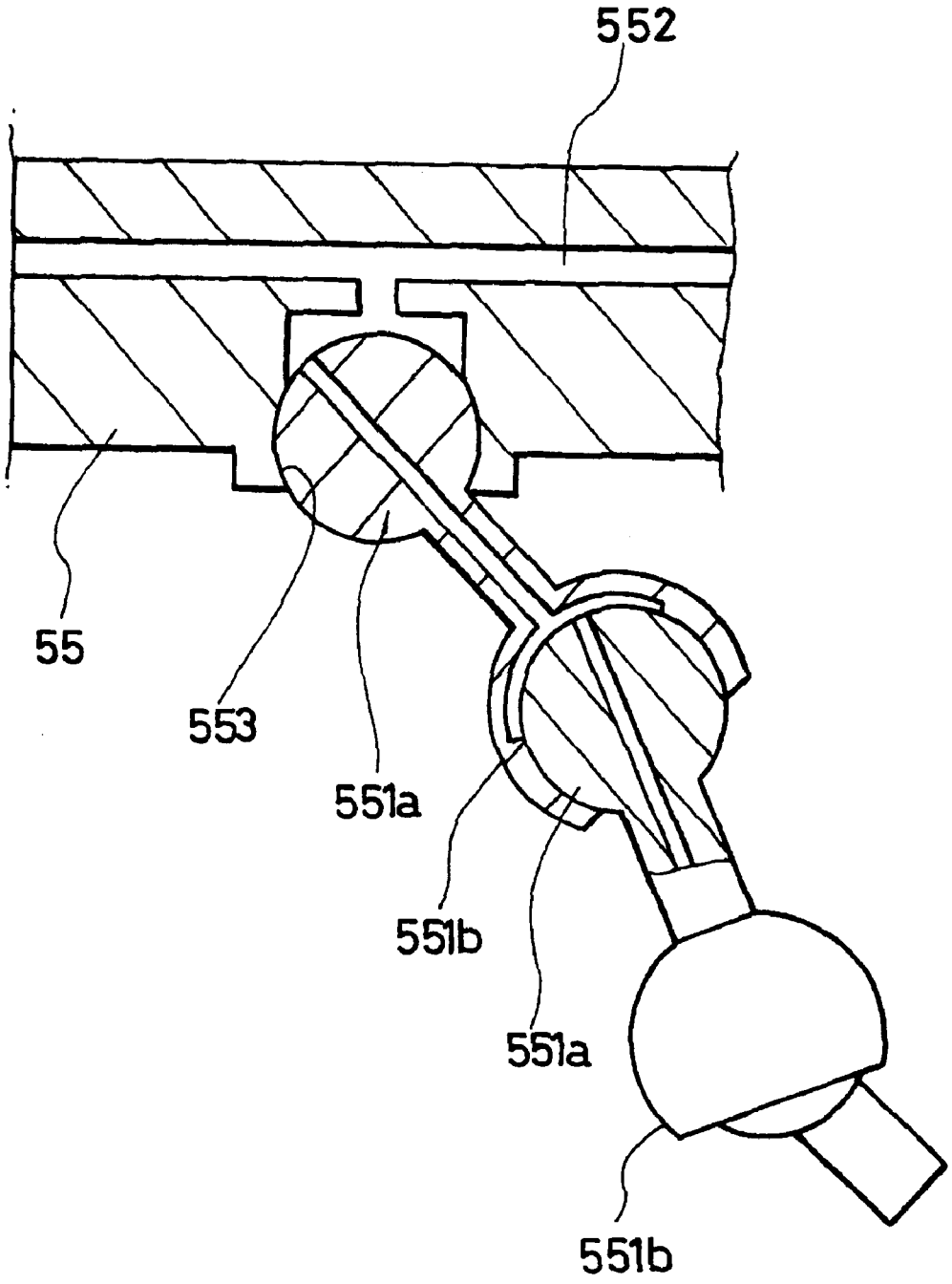

Also, as shown in FIG. 6*e*, a plurality of rounded groove portions 553 which extend in a direction orthogonal to each water passing hole 552, are defined on the lower surface of the washing body 55 in such a way as to be communicated with each water passing hole 552. Each nozzle 551 includes a plurality of articular segments each of which has a spherical portion 551a and a connecting portion 551b so that the plurality of articular segments are sequentially and articulately connected one with another. By this, an angle of each nozzle 551 can be adjusted in an easy manner.

Thus, in the case that the washing means 5 is operated, as shown in FIGS. 6*a* through 6*e*, in a state wherein the pulp forming which is squeezed against the collecting mold part 21 constituting the pulp collecting means 2, is picked out, as a control section perceives a raised position of the collecting mold part 21, the horizontal cylinder 53 which is mounted to the bracket 54, is actuated so as to move the washing body 55 above the pulp fluid bath 111. That is to say, when the washing body 55 is moved by the horizontal cylinder 53, both side ends of the washing body 55 are respectively guided along the elongate grooves 513. When movement of the washing body 55 is completed, the plurality of branched passages 512 which are defined inward of the elongate grooves 513 and the plurality of water passing holes 552 which are defined through the washing body 55 are respectively communicated with each other.

Thereafter, in a state wherein the washing body 55 is placed above the pulp fluid bath 111, water is supplied into the pair of horizontal guides 51 through the pair of water supplying hoses 52. Then, the water passes through the plurality of branched passages 512 and flows into the plurality of water passing holes 552 which are defined through the washing body 55. Thereupon, the water is injected downward through the plurality of nozzles 551. Accordingly, the water which is injected through the nozzles 551, serves to remove pulp material which remains on the collecting mold part 21 constituting the pulp collecting means 2.

Also, in consideration of the configuration of the mold, by initially adjusting angles of the nozzles 551 which are mounted to the lower surface of the washing body 55, it is possible to maximize a cleaning effect for the metal mesh.

Figure 7:
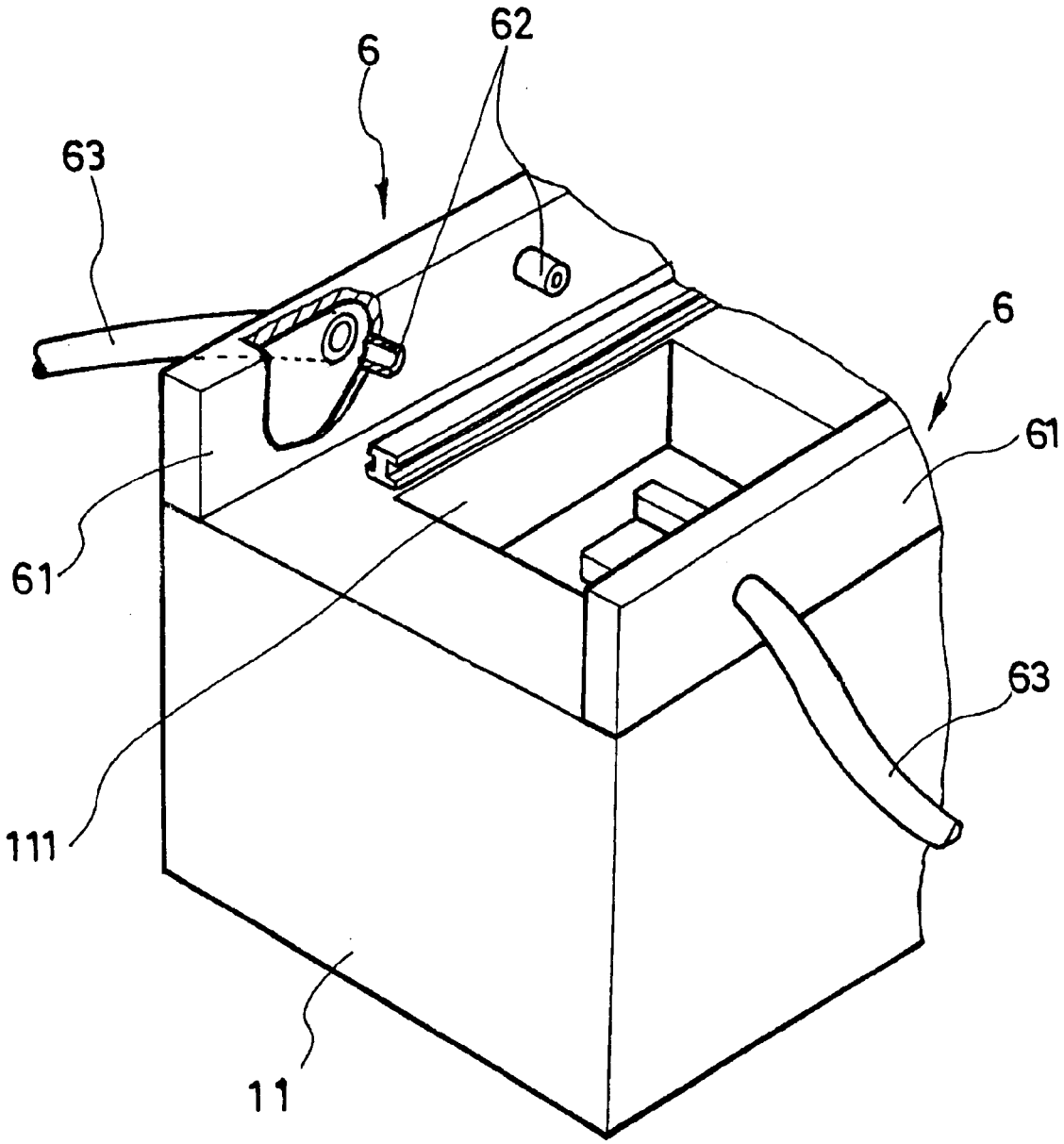
FIG. 7 is a perspective view illustrating a mounted state of pulp sucking means according to the present invention.

FIG. 7 is a perspective view illustrating a mounted state of the pulp sucking means according to the present invention. The pulp sucking means 6 includes a pair of closed boxes 61, a plurality of suction nozzles 62 and a plurality of hoses 63. The pair of closed boxes 61 are respectively located at the both sides of the frame 11, and a space is defined in each of the pair of closed boxes 61 in such a way as to suck and thereby collect dispersed pulp material. The plurality of suction nozzles 62 are mounted to inner walls of the pair of closed boxes 61. The plurality of hoses 63 are mounted to outer walls of the pair of closed boxes 61 and are connected to a pump.

Hence, by the fact that the pulp sucking means 6 rapidly sucks pulp material which is dispersed over rails, guides and the like which are disposed above the frame 11, while the manufacturing apparatus is operated, it is possible to prevent pulp material from being solidified on surfaces of the rails, guides and the like.

Figure 8:
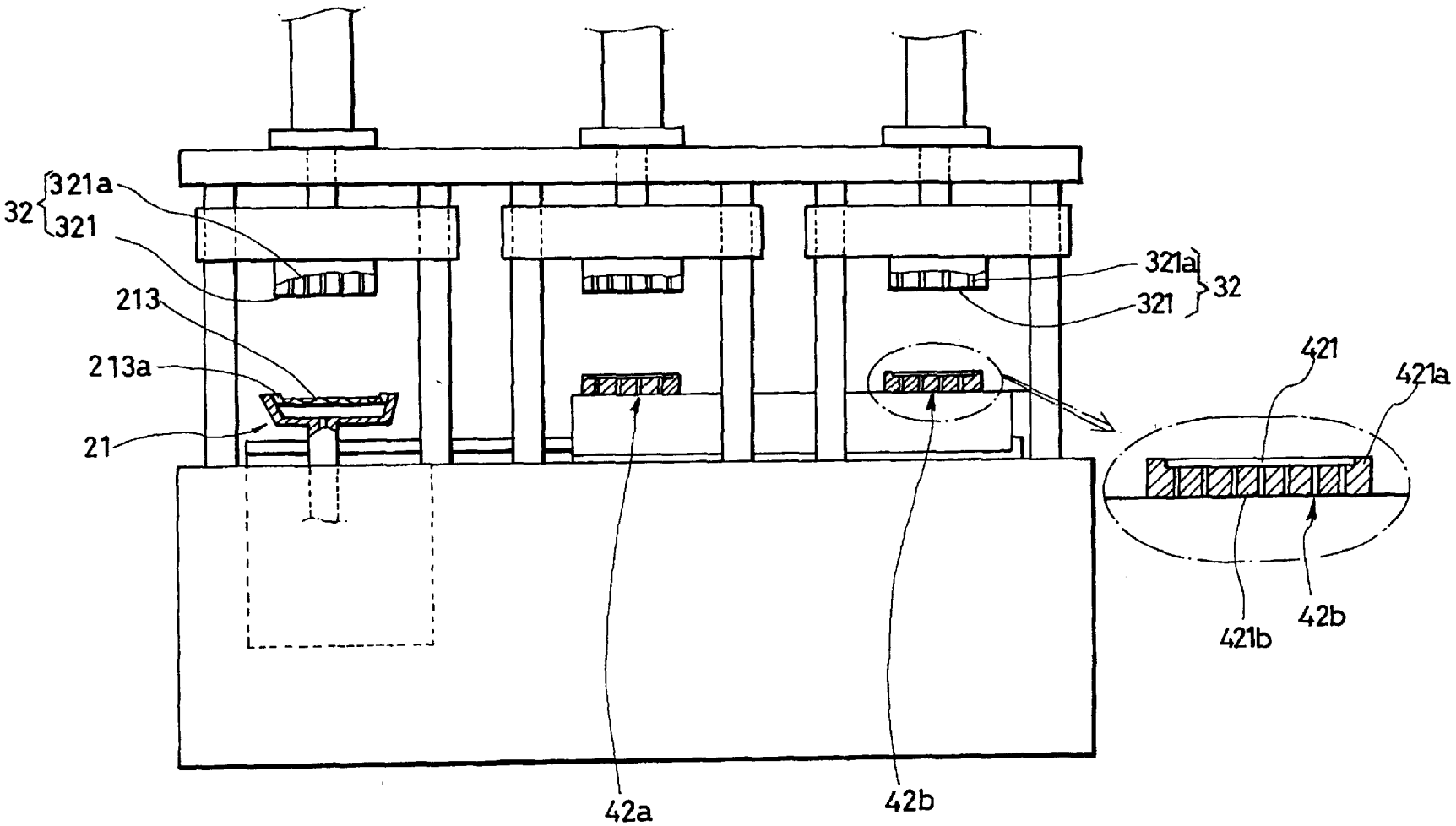
FIG. 8 is a schematic side view illustrating a collecting mold part and upper and lower molds in accordance with another embodiment of the present invention.

FIG. 8 is a schematic side view illustrating a collecting mold part and upper and lower molds in accordance with another embodiment of the present invention. The collecting mold part 21 includes a single mesh plate 213 which is formed, on an upper surface and adjacent to edges thereof, with projections 213*a*. Lower ends of the upper molds 32 form plain surfaces 321 each of which is defined with a plurality of suction holes 321*a*. Upper ends of the first and second lower molds 42*a* and 42*b* form plain surfaces 421 each of which is defined with a plurality of suction holes 421*b*, with projections 421*a* formed adjacent to edges of the upper ends of the first and second lower molds 42*a* and 42*b*. By this, it is possible to manufacture a thick pulp plate having an adequate thickness.

Figure 9A:
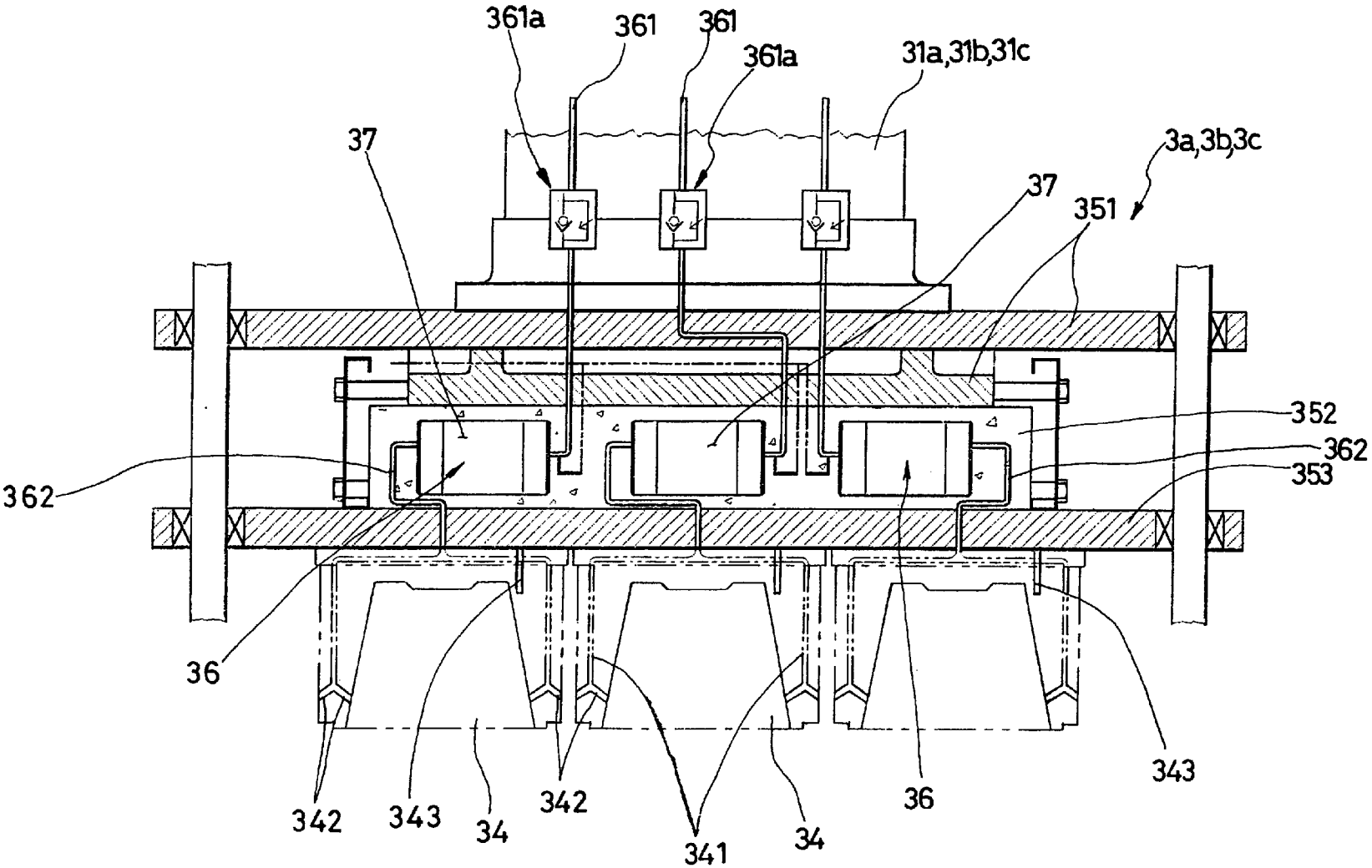
Figure 9B:
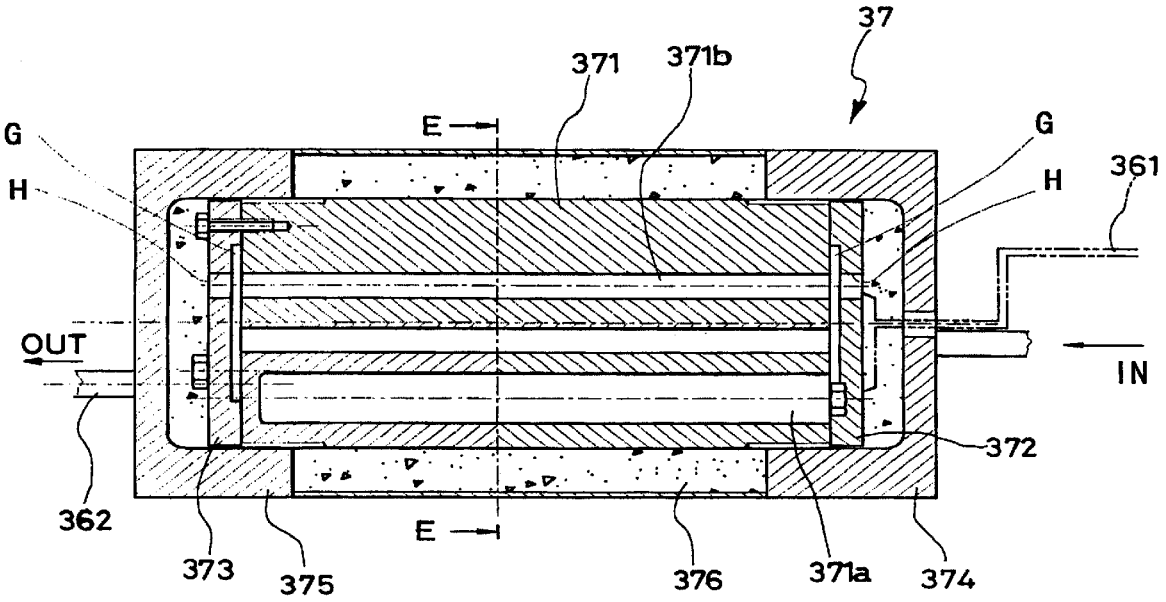
Figure 9C:
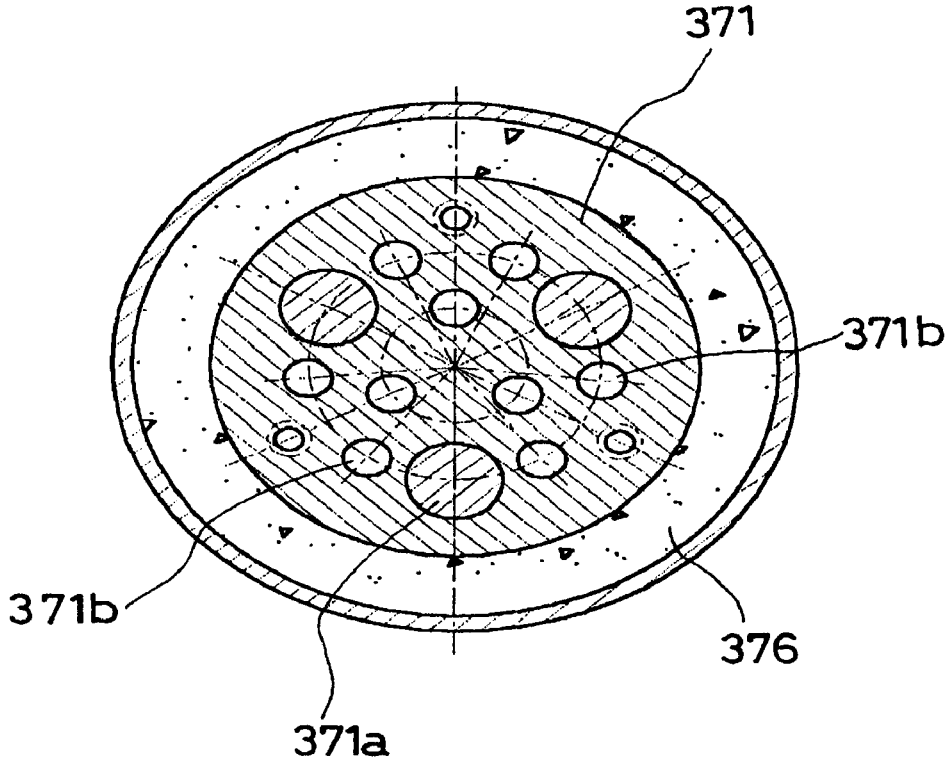
Figure 10:
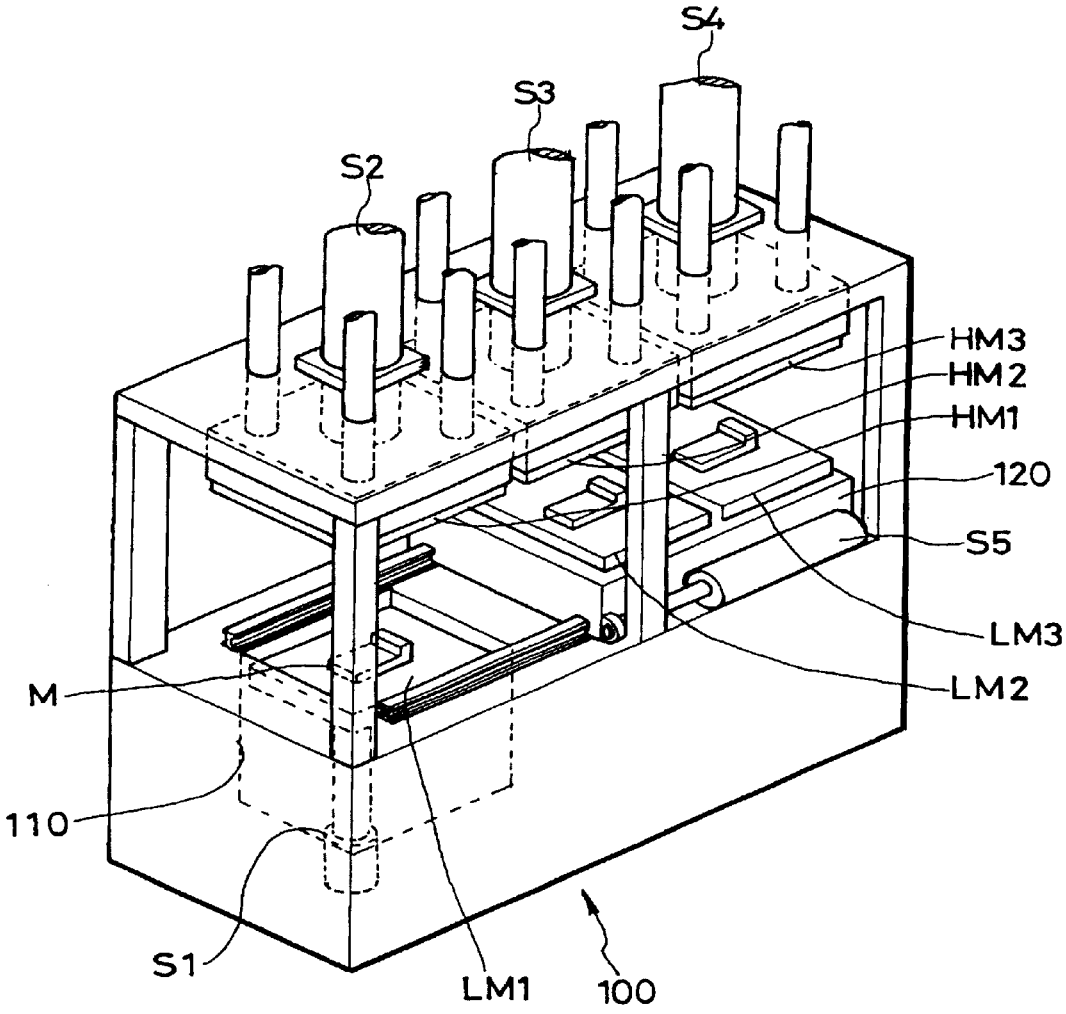
FIG. 10 PRIOR ART
FIG. 10 is a schematic perspective view illustrating a conventional pulp product manufacturing apparatus.

FIGS. 9*a* through 9*c* illustrate upper squeezing means in accordance with still another embodiment of the present invention. As shown in FIG. 9*a*, the first through third upper squeezing means 3*a*, 3*b* and 3*c* include a single upper plate 351, a heat insulating material 352, a mold base 353, a plurality of heating devices 36, and at least one upper mold 34. The single upper plate 351 is fastened to rods of the first through third cylinders 31*a*, 31*b* and 31*c*. The heat insulating material 352 is mounted to a lower end of the single upper plate 351. The mold base 353 is mounted to a lower end of the heat insulating material 352. The plurality of heating devices 36 are disposed in the heat insulating material 352 so as to heat air flowed therein from the outside. The at least one upper mold 34 is mounted to a lower end of the mold base 353 and is defined with a plurality of air passing holes 341 in such a way as to allow air heated by the plurality of heating devices 36 to be circulated therethrough and thereby be raised in its temperature.

A plurality of air discharging holes 342 are defined in the upper mold 34 in such a way as to be communicated with the plurality of air passing holes 341 and with the outside and thereby be capable of directly transmitting hot air to the pulp product. At least one thermistor 343 is inserted into the upper mold 34 in such a way as to enable a temperature of the upper mold 34 to be sensed and thereby the heating devices 36 to be controlled.

Each of the heating devices 36 includes an outside air inlet line 361, a heater box 37 and a heated air outlet line 362. Air is supplied through the outside air inlet line 361 into the heating device 36. A flow adjusting valve 361*a* for adjusting an air flowing amount is mounted to the outside air inlet line 361. The heater box 37 is connected to the outside air inlet line 361 and is placed in the heat insulating material 352. The heated air outlet line 362 is communicated with the air passing holes 341 in such a way as to supply air discharged from the heater box 37 to the upper mold 34.

Also, as shown in FIGS. 9*b* and 9*c*, the heater box 37 includes an inner cartridge 371, inlet-side and outlet-side cartridge covers 372 and 373, inlet-side and outlet-side covers 374 and 375, and heat insulating pieces 376. The inner cartridge 371 is centrally positioned in the heater box 37. A plurality of heaters 371a are circularly arranged in the inner cartridge 371 in such a way as to be spaced apart one from another in a circumferential direction by a predetermined angle. The inner cartridge 371 is formed, between the heaters 371*a*, with a plurality of air circulating holes 371*b*. The inlet-side and outlet-side cartridge covers 372 and 373 are respectively mounted to both ends of the inner cartridge 371. Inner surfaces of the inlet-side and outlet-side cartridge covers 372 and 373 are defined with air flowing grooves G for allowing air flow therein. Also, a plurality of air passing holes H are defined through the inlet-side and outlet-side cartridge covers 372 and 373. The inlet-side and outlet-side covers 374 and 375 respectively surround the both ends of the inner cartridge 371. The outside air inlet line 361 and the heated air outlet line 362 are respectively connected to the inlet-side and outlet-side covers 374 and 375. The heat insulating pieces 376 are arranged inside the inlet-side and outlet-side covers 374 and 375 so as to prevent heat generated in the inner cartridge 371 from being dissipated to the outside.

In the case that the upper mold 34 which is mounted to the first through third upper squeezing means 3*a*, 3*b* and 3*c*, is pre-heated before the manufacturing apparatus according to the present invention is operated, power is first applied to the plurality of heaters 371*a* which are circularly arranged in the heater box 37, and thereby, a temperature of the inner cartridge 371 is raised. Thereafter, by opening the flow adjusting valve 361*a* which is mounted to the middle of the outside air inlet line 361, outside air flows into the heater box 37 and thereby, a temperature of the air is raised. Then, by supplying the heated air through the heated air outlet line 362 to the upper mold 34, the upper mold 34 can be pre-heated.

Namely, if the outside air flows into the heater box 37, the inflow of air passes through the inlet-side cover 374 and the inlet-side cartridge cover 372 and flows through the plurality of air circulating holes 371*b* which are defined in the inner cartridge 371. Then, the air passes through the outlet-side cartridge cover 373 and the outlet-side cover 375. Thereupon, the heated air is supplied through the heated air outlet line 362 to the upper mold 34.

The heated air which is supplied to the upper mold 34, flows through the plurality of air passing holes 341 which are defined in the upper mold 34. After raising a temperature of the upper mold 34, the heated air is discharged to the outside through the plurality of air discharging holes 342. In this way, the heated air is injected to a surface of the pulp forming.

Further, by the fact that the thermistor 343 is mounted to the upper mold 34 so as to sense a temperature of the upper mold 34, actuations of the heating parts 36 can be frequently and precisely controlled.

As a result, the pulp product manufacturing apparatus according to the present invention provides advantages in that, since the apparatus is automatized, quality of pulp products and productivity of the manufacturing apparatus are improved, since an expense required for disposing separate columns is saved, a cost of the entire manufacturing apparatus is reduced, and since stability upon raising and lowering of upper squeezing means is secured, it is possible to manufacture a pulp product of high quality.

Also, by the fact that an unnecessary bulk of a pulp fluid bath is removed, a volume of the pulp fluid bath can be minimized, a raising and lowering part constituting pulp collecting means is prevented from being corroded due to pulp fluid or the pulp fluid is prevented from being solidified on the raising and lowering part and thereby a lifetime of the raising and lowering part is lengthened, and a repairing operation for the raising and lowering part can be implemented in an easy manner.

Further, because a forward and rearward moving part constituting lower squeezing means is disposed below a movable member, it is possible to prevent foreign substances such as pulp material from flowing into a cylinder constituting the forward and rearward moving part, whereby it is possible to keep the manufacturing apparatus from being broken down.

Moreover, due to the fact that an angle of each of a plurality of nozzles mounted to a lower surface of a washing body can be adjusted depending upon a configuration of a collecting mold part, a removing effect for the pulp material remaining on the collecting mold part can be elevated.

Furthermore, the pulp product manufacturing apparatus according to the present invention can manufacture a thick pulp plate having a proper thickness.

Besides, when at least one of hot wires constituting a heating part of the upper squeezing means is damaged, a hot wire changing operation can be quickly implemented.

In addition, since only upper molds constituting the upper squeezing means are heated, heat loss is minimized and a preheating time is shortened when arranging the manufacturing apparatus for a manufacturing procedure, whereby it is possible to prevent waste of electric power.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. A pulp product manufacturing apparatus comprising:

a body having a frame and an upper fastening plate, the frame having two side walls and housing a pulp fluid bath therebetween and adjacent a front end of said frame, said pulp fluid bath having a collecting mold part of pulp collecting means disposed therein, pulp residing in the pulp fluid bath being squeezed against said collecting mold part which is capable of discharging water, said pulp collecting means further including a raising and lowering part disposed beneath said pulp fluid bath for raising and lowering said collecting mold part, the upper fastening plate being disposed at a predetermined separation from an upper end of the frame;

first through third upper squeezing means respectively having upper molds and heating parts which are repeatedly raised and lowered by first through third cylinders mounted to the upper fastening plate so as to dry pulp using heat;

a plurality of guide columns extending through comer portions of the first through third upper squeezing means and having upper and lower ends which are respectively fastened to a lower surface of the upper fastening plate and an upper surface of the frame;

lower squeezing means including a movable member and first and second lower molds which are repeatedly moved forward and rearward relative to said front end of said frame by a forward and rearward moving part which is mounted between both side walls of the frame, said movable member mounted to said forward and rearward moving part, and said first and second lower molds mounted to an upper surface of said movable member;

washing means arranged at said front end of the frame and repeatedly moved above the pulp fluid bath for washing the collecting mold part after pulp is removed from the collecting mold part; and pulp sucking means mounted along a length of each of said side walls of the frame adjacent to the upper end of the frame, for sucking and collecting dispersed pulp material.

2. The apparatus as claimed in claim 1, wherein the collecting mold part of the pulp collecting means comprises a raising and lowering body in which a water discharging space is defined, and at least one mesh mold which is mounted onto the raising and lowering body and has a configuration of a desired pulp product; and the raising and lowering part of the pulp collecting means comprises a water discharging pipe which is mounted to a lower end of the raising and lowering body in such a way as to be communicated with the water discharging space and extends through a bottom of the pulp fluid bath and to which a flexible tube is connected, a cylinder which is vertically mounted to a lower end of the water discharging pipe, and a guide portion for guiding movement of the water discharging pipe upon raising and lowering of a rod of the cylinder.

3. The apparatus as claimed in claim 2, wherein the guide portion comprises an upper body which is mounted to a lower surface of the pulp fluid bath and to which upper ends of a plurality of guide shafts are fastened, a lower body which is mounted to an upper end surface of the cylinder, through which the rod of the cylinder passes and to which lower ends of the plurality of guide shafts are fastened, and a moving bracket which is arranged adjacent to the lower end of the water discharging pipe and is repeatedly raised and lowered along the plurality of guide shafts when the cylinder is actuated.

4. The apparatus as claimed in claim 1, wherein the forward and rearward moving part constituting the lower squeezing means comprises a cylinder bracket which connects rear ends of the both side walls of the frame with each other, at least one cylinder which is mounted to a center portion of the cylinder bracket in a manner such that a rod of the cylinder can be freely moved in the forward and rearward directions, and at least one supporting plate which connects the rod of the cylinder and the movable member with each other.

5. The apparatus as claimed in claim 1, wherein each of the heating parts constituting the first through third upper squeezing means comprises a single upper plate which is fastened to a rod of each cylinder, a heat insulating element which is attached to a lower surface of the single upper plate, a hot plate which is attached to a lower surface of the heat insulating element and in which a plurality of hot wires are arranged in a horizontal direction, a mold base which is attached to a lower surface of the hot plate and to which each upper mold is mounted, and a pair of covers which are disposed at both sides of the single upper plate, hot plate and mold base in such a way as to enable the hot wires to be changed with new ones by removing them.

6. The apparatus as claimed in claim 1, wherein the washing means comprises a pair of horizontal guides which are respectively mounted to both sides of the frame adjacent said front end and to which a pair of water supplying hoses are respectively connected, a bracket which is fastened to said front end of the frame and to which a horizontal cylinder is mounted, and a washing body which is fastened to a free end of a rod of the horizontal cylinder and is slidably fitted between the pair of horizontal guides and to a lower surface of which a plurality of nozzles each capable of being adjusted in its angle, are mounted.

7. The apparatus as claimed in claim 6, wherein a main passage to which water is supplied, is defined in a middle portion of each horizontal guide, a plurality of branched passages which extend in a direction orthogonal to the main passage, are defined through the horizontal guide in such a way as to be communicated at one ends thereof with the main passage and be spaced apart one from another by a predetermined distance, an elongate groove into which one side end of the washing body is slidably fitted, is defined on an inner wall surface of the horizontal guide in such a way as to be communicated with the other ends of the plurality of branched passages, a plurality of water passing holes are defined through the washing body in such a way as to be communicated with the plurality of branched passages for receiving water and be spaced apart one from another by the predetermined distance by which the plurality of branched passages are spaced apart one from another, a plurality of rounded groove portions which extend in a direction orthogonal to each water passing hole, are defined on the lower surface of the washing body in such a way as to be communicated with each water passing hole, and each nozzle includes a plurality of articular segments each of which has a spherical portion and a connecting portion so that the plurality of articular segments are sequentially and articulately connected one with another.

8. The apparatus as claimed in claim 1, wherein the pulp sucking means comprises a pair of closed boxes which respectively extend along both sides of the frame and in each of which a space is defined in such a way as to suck and thereby collect dispersed pulp material, a plurality of suction nozzles which are mounted to inner walls of the pair of closed boxes, and a plurality of hoses which are mounted to outer walls of the pair of closed boxes and are connected to a pump.

9. The apparatus as claimed in claim 1, wherein the collecting mold part comprises a single mesh plate which is formed, on an upper surface and adjacent to edges thereof, with projections, so as to be capable of manufacturing a thick pulp plate, lower ends of the upper molds form plain surfaces each of which is defined with a plurality of suction holes, and upper ends of the first and second lower molds form plain surfaces each of which is defined with a plurality of suction holes, with projections formed adjacent to edges of the upper ends of the first and second lower molds.

10. The apparatus as claimed in claim 1, wherein the first through third upper squeezing means include a single upper plate which is fastened to rods of the first through third cylinders, a heat insulating material which is mounted to a lower end of the single upper plate, a mold base which is mounted to a lower end of the heat insulating material, a plurality of heating devices which are disposed in the heat insulating material so as to heat air flowed therein from the outside, and at least one upper mold which is mounted to a lower end of the mold base and is defined with a plurality of air passing holes in such a way as to allow air heated by the plurality of heating devices to be circulated therethrough and thereby be raised in its temperature.

11. The apparatus as claimed in claim 10, wherein a plurality of air discharging holes are defined in the upper mold in such a way as to be communicated with the plurality of air passing holes and with the outside and thereby be capable of directly transmitting hot air to a pulp product, and at least one thermistor is inserted into the upper mold in such a way as to enable a temperature of the upper mold to be sensed and thereby the heating devices to be controlled.

12. The apparatus as claimed in claim 10, wherein each of the heating devices comprises an outside air inlet line through which air is supplied into the heating device and to which a flow adjusting valve for adjusting an air flow is mounted, a heater box which is connected to the outside air inlet line and is placed in the heat insulating material, and a heated air outlet line which is communicated with the air passing holes in such a way as to supply air discharged from the heater box to the upper mold.

13. The apparatus as claimed in claim 12, wherein the heater box comprises an inner cartridge which is centrally positioned, in which a plurality of heaters are circularly arranged in such a way as to be spaced apart one from another in a circumferential direction by a predetermined angle and which is formed, between the heaters, with a plurality of air circulating holes, inlet-side and outlet-side cartridge covers which are respectively mounted to both ends of the inner cartridge, inner surfaces of which are defined with air flowing grooves for allowing air flow therein and through which a plurality of air passing holes are defined, inlet-side and outlet-side covers which respectively surround the both ends of the inner cartridge and to which the outside air inlet line and the heated air outlet line are respectively connected, and heat insulating pieces which are arranged inside the inlet-side and outlet-side covers so as to prevent heat generated in the inner cartridge from being dissipated to the outside.

* * * * *